US006173670B1

(12) United States Patent
Davidson

(10) Patent No.: US 6,173,670 B1
(45) Date of Patent: Jan. 16, 2001

(54) COMBINED AERODYNAMIC AND HYDRODYNAMIC ALUMINUM BOAT HULL

(75) Inventor: Samuel L. Davidson, Monroe, LA (US)

(73) Assignee: Duracraft Marine Corporation, Delphi, LA (US)

( * ) Notice: Under 35 U.S.C. 154(b), the term of this patent shall be extended for 0 days.

(21) Appl. No.: 09/245,904

(22) Filed: Feb. 8, 1999

(51) Int. Cl.[7] ..... B63B 1/00
(52) U.S. Cl. ..... 114/271
(58) Field of Search ..... 114/355, 356, 114/357, 358, 359, 364, 271, 61.27

(56) References Cited

U.S. PATENT DOCUMENTS

| | | | | |
|---|---|---|---|---|
| 3,032,785 | * | 5/1962 | Ward et al. | 114/356 |
| 5,322,030 | * | 6/1994 | Brehmer | 114/343 |
| 5,676,080 | * | 10/1997 | Allen | 114/356 |
| 5,685,253 | * | 11/1997 | Alexander | 114/271 |

OTHER PUBLICATIONS

Xpress, Since 1965 The Original All Welded Boat, 1998.
Dura Craft, Value Engineered for a Lifetime.
Sea Ark Boats, Aluminum Jon Boats, Super Jons, Fishing Boats & Deck Style Boats.
Crestliner, The Leader by Innovation.

* cited by examiner

*Primary Examiner*—Jesus D. Sotelo
(74) *Attorney, Agent, or Firm*—Jacobson, Price, Holman & Stern, PLLC

(57) ABSTRACT

A performance vee hull that can be made with conventional aluminum manufacturing techniques on a relatively economical basis. The hull uses the lift of a concave bow, the off-setting "hold down" of strakes without lift characteristics, the tracking and drag of a keel and an integrally formed off-set motor mount with a full transom to produce a "severe vee" hull configuration (10–15 degrees inclination per side, 20–30 degrees total vee shape). The hull has a curved, reverse or concave flared bow. A bottom surface of the hull terminates at a rear edge. Behind the rear edge is a set-back section. A transom extends across the rear of the boat, and is relatively flat all the way across. The set-back section extends rearwardly 4–8 inches from the transom and has a bottom surface that is above the bottom edge of the transom, about 3–6 inches.

18 Claims, 5 Drawing Sheets

COMBINED AERODYNAMIC AND HYDRODYNAMIC ALUMINUM BOAT HULL

FIELD OF THE INVENTION

The present invention relates to the field of aluminum boat hulls, and in particular to aluminum boat hulls having a bottom and transom configured to maximize performance.

BACKGROUND OF THE INVENTION

Concave bows, keels, strakes that extend longitudinally, off-sets or jack plates, and vee shaped hulls are not new to boats intended to be powered by outboard engines. However, each of these items is used in a separate, particular way.

For example, providing a keel on a boat is known to increase its tracking ability, but it is also known to provide drag and generally is considered to decrease speed. Therefore, few "performance" or high speed boats have keels.

Strakes are normally used for two reasons, namely to increase the strength of a boat bottom, and when disposed with one strake surface parallel to the water surface, to give lift. In aluminum boats, in particular, strakes are generally tapered at the rear end so that they do not prevent bow lift, or if not tapered at the rear end, then the transom is formed with a tapered corner to insure some lift but this increases so called "draft".

"Set-backs" are somewhat common for performance bass boats with so-called pad hulls. Pad hulls have narrow (8–14 inches) centrally located longitudinal bottom surfaces that are flat or only slightly "veed" or concaved. These bottom surfaces provide a minimum water contact surface area and thereby enhance the boat speed. However, on larger boats, the "set-back" is normally provided by a separate bracket that sits the engine 12 or more inches behind the hull, and not by a set back of 4–8 inches that is formed integrally with the boat.

Vee hulls are common in outboard motor boats because they are known for their softer ride and "rough water" abilities. However, aluminum vee shaped hulls with performance characteristics that approach fiberglass, are not known to the outboard motor boat market.

If there was such a thing as a performance vee hull that could be made by "high speed" (rather than custom hand crafted) production techniques before the present invention, then its contours were such that the hull either had to be made of molded fiberglass or made with sophisticated aluminum "stretch forming" techniques. Molding of a hull with fiberglass is a manual operation including applying layers of fiberglass into a mold of any desired configuration and such application takes extended periods of time and presents numerous environmental problems.

The present state of the art wisdom is: keels provide drag, strakes either are tapered at the back or the hull has "cut corners", jack-plates on vee hulls commonly sit far back (not 4–8 inches), concave bows are for pad boats (not for severe 15 degrees or more vees), and normal aluminum production techniques are not suited to economically provide a performance vee.

SUMMARY OF THE INVENTION

It is therefore an object of the present invention to provide a performance vee shaped hull that can be made with conventional aluminum manufacturing techniques on a relatively economical basis. The hull uses the lift of a concave bow, the off-setting "hold down" of strakes without lift characteristics, the tracking and drag of a keel and an integrally formed off-set motor mount, projecting rearwardly only 4–8 inches from a full transom to produce a "severe vee" hull configuration (10–15 degrees inclination per side, 20–30 degrees total vee shape).

The hull of the present invention has a curved, reverse or concave flared bow. A bottom surface of the hull terminates at a rear edge. Behind the rear edge is a set-back section. A transom extends across the rear of the boat, and, in a preferred embodiment, is relatively flat all the way across. The set-back section extends rearwardly 4–8 inches from the transom and has a bottom surface that is above the bottom edge of the transom, preferably about 3–6 inches. However, this bottom edge, while still above the bottom surface of the hull at least 3" can be "V" or curved in shape.

Along the center of the hull bottom is the keel. On opposite sides of the keel, the bottom surface of the hull is formed with parallel longitudinal strakes that extend the full length of the bottom surface, rearwardly of the bow area, with a constant cross-section. These strakes are "U" shape in cross sectional contour but can be vee or "L" shaped. The two aluminum sections which include the strakes and which are welded to a central keel, extend at an angle of 10–15° to the horizontal, to form a V-shaped hull of 20–30° to the horizontal.

An outboard engine is mounted on the set-back section to propel the hull. If desired, wedge shaped lips can be provided at the outer edge of the hull bottom to minimize any excessive bow lift caused by the strakes during initial application of power by the outboard engine.

The hull of the present invention can be used in a so called "bass boat" arrangement or "bay boat" arrangement. In a 19 foot long configuration, with a 66 inch wide bottom, the boat hull of the present invention can run between 53 and 60 miles per hour when powered by a stock 115 horsepower engine, and will handle turns and rough water beyond expectations.

A boat hull according to the present invention, adapted to be powered by an outboard engine, is made from aluminum by conventional production techniques and equipment. Aluminum allows the boat to be used in "abusive" environments such as rocky or reef areas since impact to aluminum will cause little or no damage when impact to fiberglass would cause fractures.

The boat hull, because of its hydrodynamic and aerodynamic configuration, provides superior handling, and turning performance characteristics when compared to shallow vee or pad hulls. A unique combination of aerodynamic lift from the concave bow, set-back of the outboard engine to maximize hydrodynamic water flow to the propeller, and severe vee hull shape, with a full transom, work together with longitudinal strakes extending to the rear bottom edge and a central keel to give unexpected, superior performance characteristics.

It is therefore another object of the present invention to provide a vee shaped aluminum hull having a central keel, with strakes extending from the bow to the stern of the hull and including a set back section for supporting an outboard motor.

It is still yet another object of the present invention to provide a vee shaped aluminum hull made of two sections of aluminum welded to a central aluminum keel and having three parallel extending strakes in each aluminum hull section, extending from the bow to the stern with a constant cross section, and including a set back section extending 4 to 8 inches rearwardly from the transom and approximately 3 to 6 inches above the lowermost edge of the transom.

It is still yet another object of the present invention to produce a bass-type or bay-type aluminum vee shaped keel with the angle of the vee shape being in the range of 15 to 30 degrees and including parallel extending strakes terminating at a rear edge of a transom above which is located a set back section for mounting of an outboard motor.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
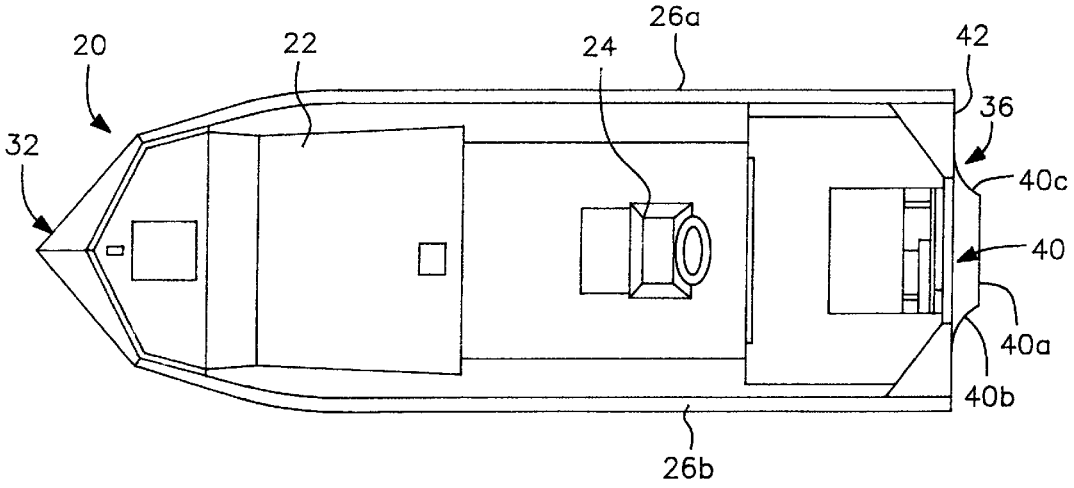
FIG. 1 is a plan view of a bay-type boat incorporating the hull design of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 7, in particular, a bay-type boat embodying the teachings of the present invention is generally designated as 20. With reference to its orientation in FIG. 1, the boat includes an upper deck 22 including a steering console mechanism 24 and gunwales 26*a*, 26*b*.

Figure 2:
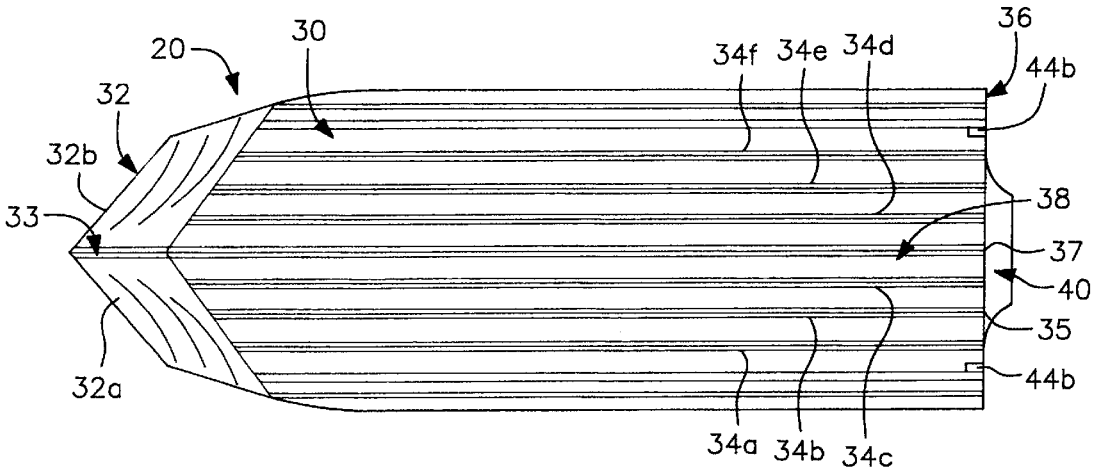
FIG. 2 is a bottom plan view of the boat of FIG. 1 illustrating a plurality of longitudinally extending, parallel strakes and a set back section for mounting an outboard engine to propel the boat.
Figure 3:
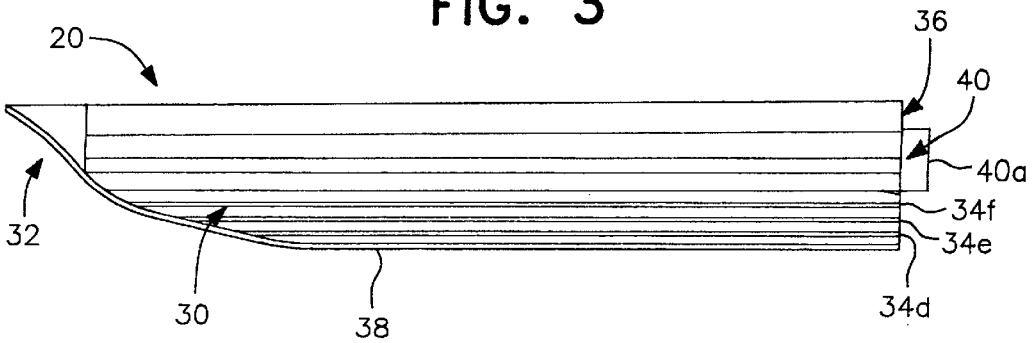
FIG. 3 is a side view of the boat of FIG. 1.

As shown in FIGS. 2 and 3, on the underside of the boat 20 is the hull 30 incorporating the inventive principles of the present invention. At the bow 32 there are concave or reversely curved sections 32*a*, 32*b* carried by a bow extrusion 33 from which initiate six strakes 34*a* through 34*f*. Each of the strakes 34*a* through 34*f* extend from a collapsed forward edge in a constant cross-sectional configuration to a rear edge 35 located at the stern 36 of the boat.

Extending centrally along the hull 30 is a keel 38 which extends the entire length of the hull up to the bow extrusion 33, terminating at the rear edge 37 of the hull located at the stern 36. At the stern of the boat is also located a set back section 40 for mounting of an outboard engine. The set back section 40 extends beyond the transom 42 of the boat.

Figure 5:
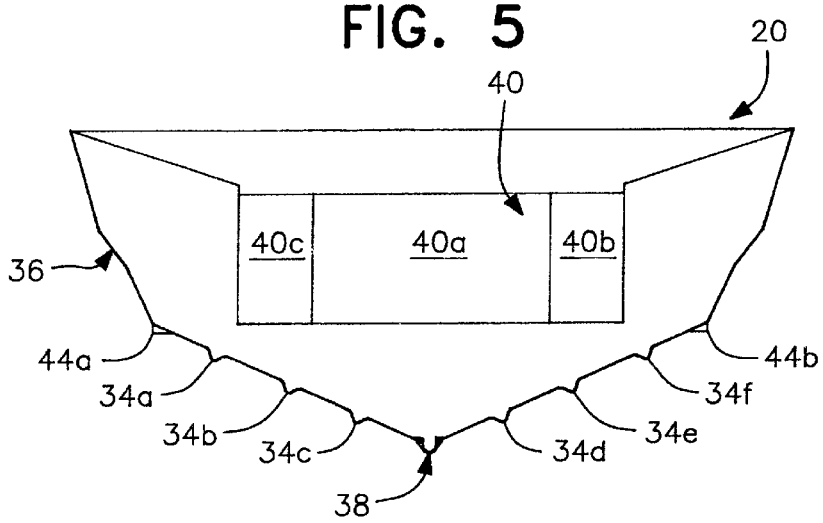
FIG. 5 is a rear view of the boat of FIG. 1, showing the stern and illustrating the set back section projecting above the bottom of the transom and the hull for mounting a motor thereon.

The set back section includes a flat section 40*a* which extends parallel to the transom of the boat. The flat section of the set back can be secured to the transom in any desired manner such as by welded channels (not shown). Two concave curved sections 40*b* and 40*c*, as shown in FIGS. 1, 2 and 5, cover the connection between the flat section 40 and the transom 42 of the boat to provide for a cosmetically attractive installation.

Figure 4:
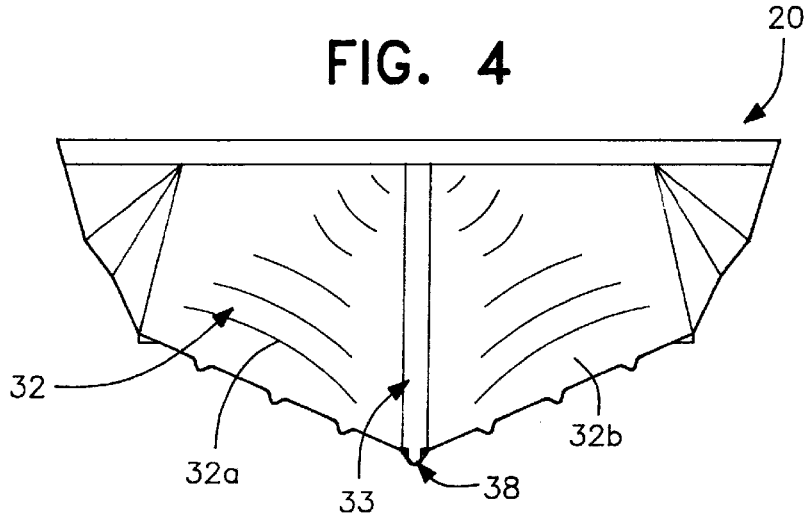
FIG. 4 is a front view of the boat of FIG. 1 showing the bow.
Figure 6:
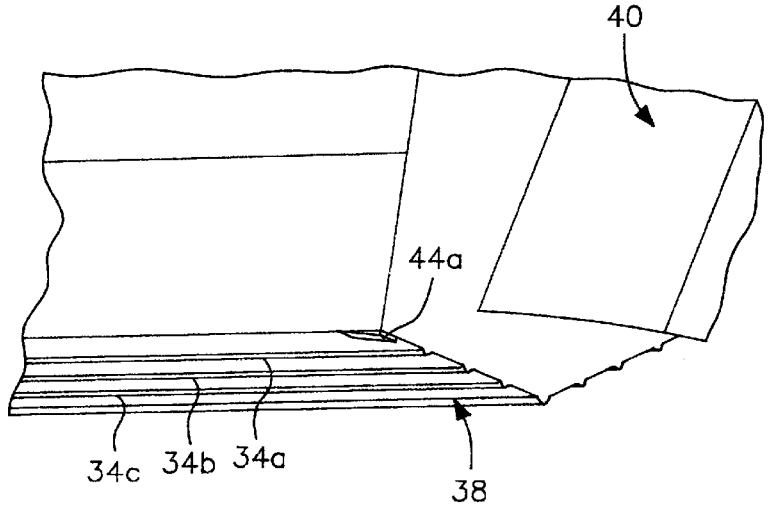
FIG. 6 is a fragmentary perspective view of a bay-type boat including outside corner wedges or lips used to minimize bow lift during initial application of power by an outboard engine.

As shown in FIGS. 2, 4 and 6, wedge shaped lips 44*a*, 44*b* are added to the bottom of the hull at two locations adjacent the rear edge 37 of the hull. The height of the wedges preferably increase in a direction from the bow to the stern, and from chine to keel as well. The lips minimize any bow lift during initial application of power from an outboard engine mounted on the set back section 40, and then, when the boat is under power, these lips have minimal or no contact with the water.

Figure 7:
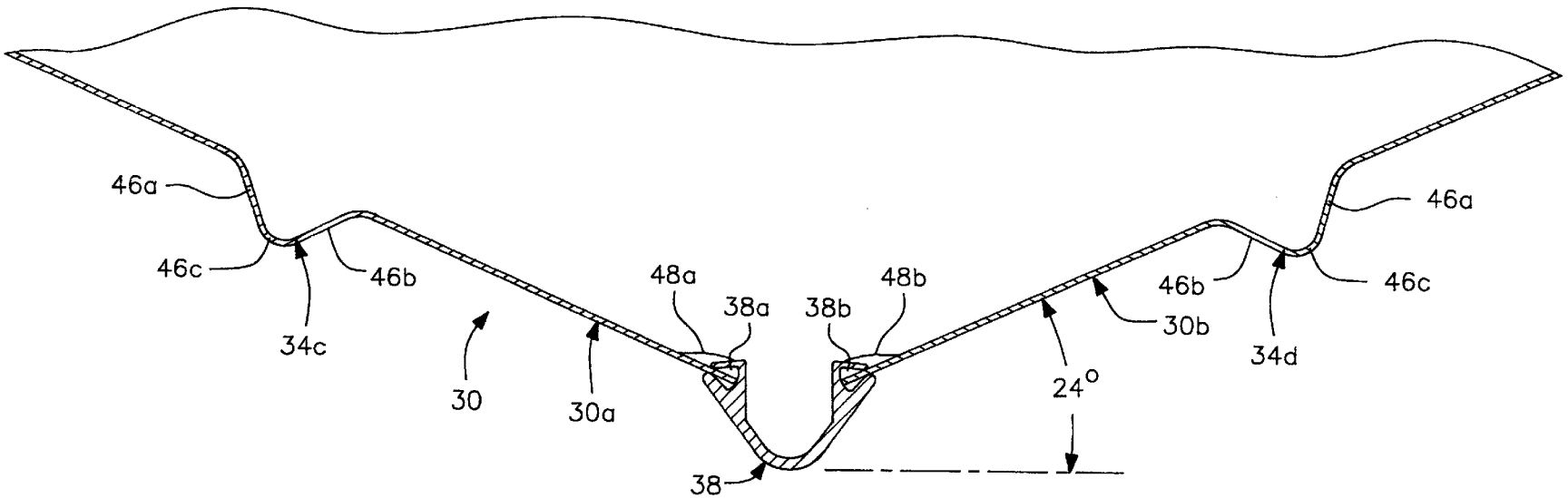
FIG. 7 is an enlarged, partial sectional view of a hull of a bay-type boat incorporating the principles of the present invention with bottom hull sections mounted within openings of a U-shaped keel.
Figure 8:
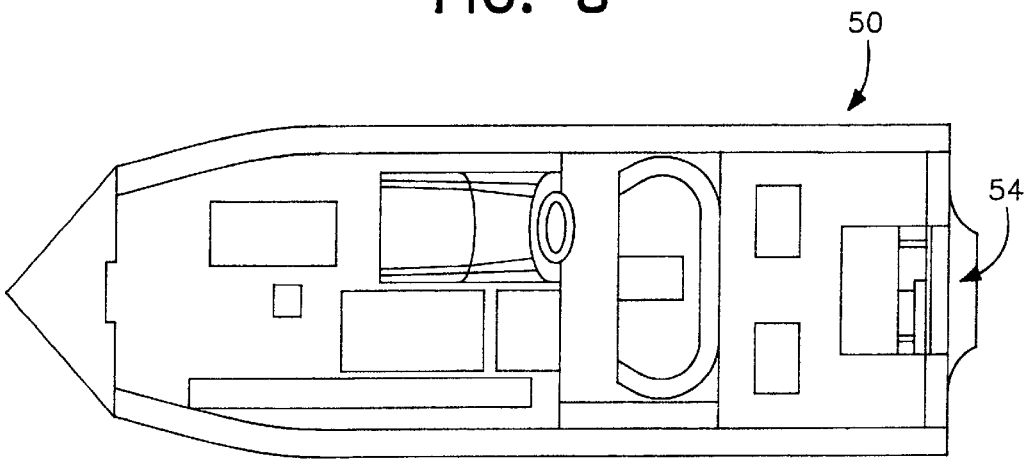
FIG. 8 is a top plan view of a bass-type boat incorporating the hull design of the present invention.
Figure 9:
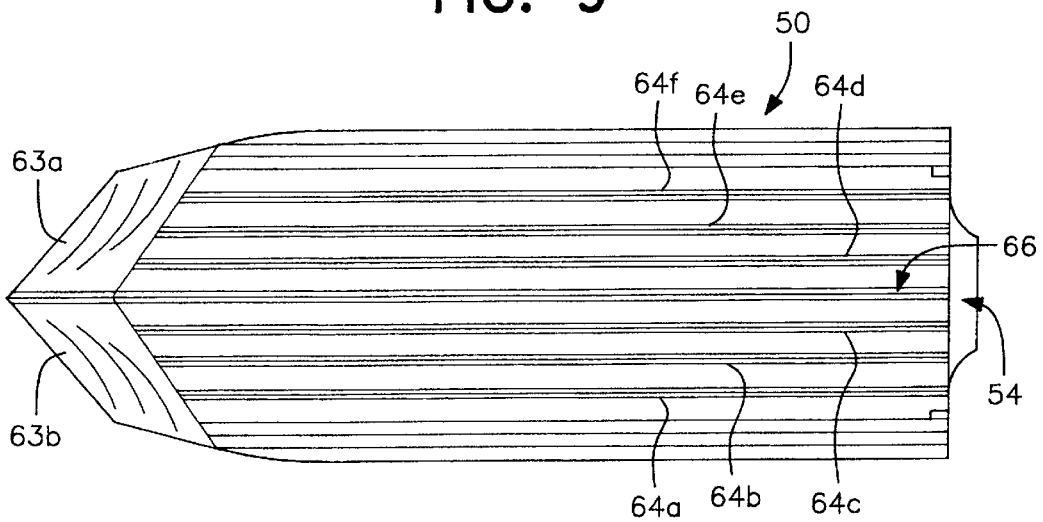
FIG. 9 is a bottom plan view of the boat of FIG. 8.
Figure 10:
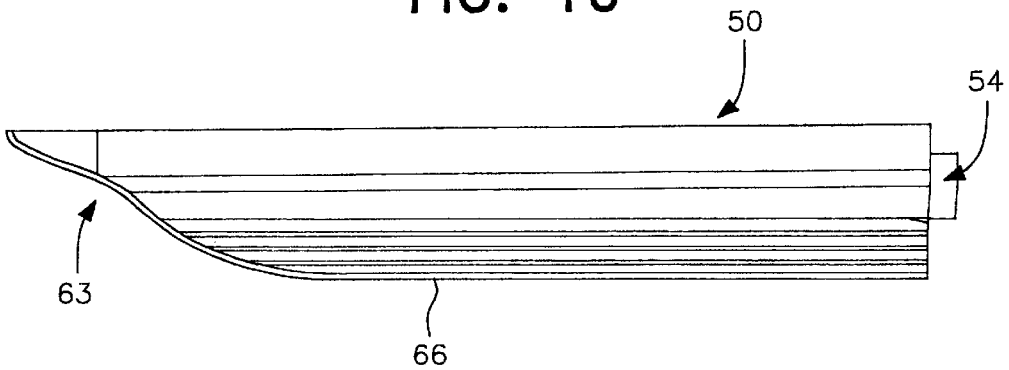
FIG. 10 is a side view of the boat of FIG. 8.
Figure 11:
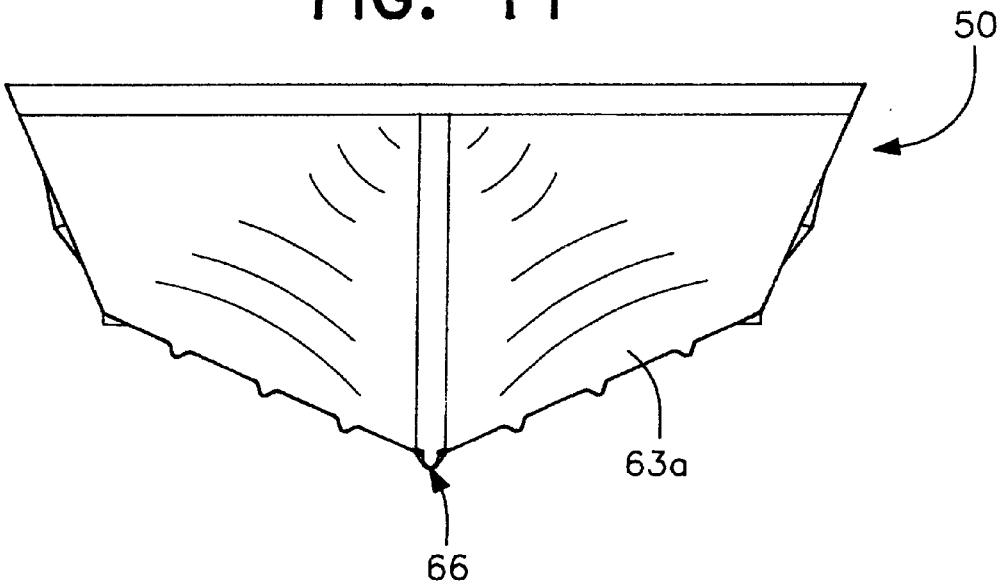
FIG. 11 is a front view showing the bow of the boat of FIG. 8.

Strakes 34*c* and 34*d* are shown in more detail in FIG. 7. These strakes are representative of all of the strakes on the hull. Each strake includes side walls 46*a*, 46*b* intersecting to form a U-shaped intersection 46*c*. In an alternative embodiment, U-shaped intersection 46*c* may be vee shaped or the configuration may be "L" shaped.

The hull 30 is made up of two aluminum sections 30*a*, 30*b*. Each section extends at an angle of approximately 10 to 15 degrees to the horizontal. The two sections 30*a*, 30*b* are held in place in the keel 38 in a conventional manner within openings 38*a*, 38*b*, respectively, such as by welds 48*a*, 48*b* located on the interior of the hull 30.

Figure 12:
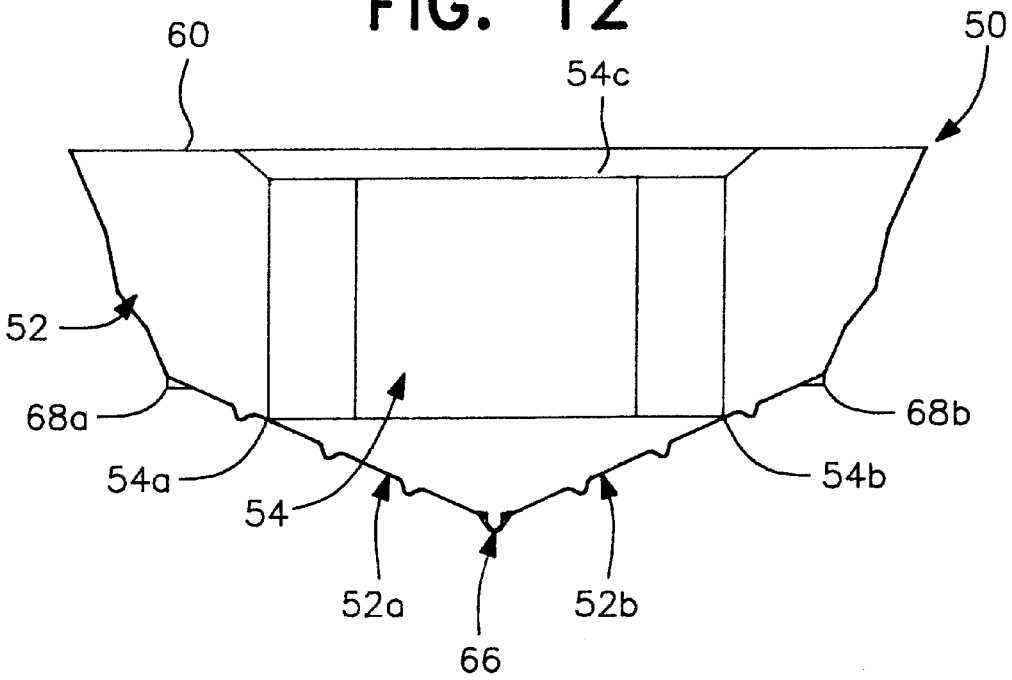
FIG. 12 is a rear view showing the stern of the boat of FIG. 8 and illustrating the elevated set back section located rearwardly of the transom.

In FIGS. 8 through 12, an alternative embodiment of the present invention is shown. In these figures, a bass-type boat 50 is shown. The primary distinctions between the bass-type boat and the bay-type boat 20 shown in FIGS. 1 through 7 is that the side height of the bay-type boat 20 is approximately 25 inches whereas the side height of the bass-type boat 50 is approximately 18 inches. In addition, as shown in FIG. 12, the hull 52 of the bass-type boat includes a set back section 54 which extends from points 54*a*, 54*b* located slightly above (approximately three inches) the bottom of the hull, extending upwardly to an upper edge 54*c* located within 1 to 2 inches of the upper edge 60 of the transom 62.

As in the bay-type boat, the bass-type boat 50 includes concave curved bow sections 63*a*, 63*b*, six strakes 64*a* through 64*f* and a central keel 66 interconnecting hull sections 52*a*, 52*b*. In addition, wedges or lips 68*a*, 68*b* are located at the rear edge 70 of the hull on opposite sides of the keel 66.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A boat for use with an outboard motor, said boat comprising:

a vee shaped hull having a central keel, a concave bow section and parallel extending strakes extending from the concave bow section and extending to a rear edge of the hull, a transom, and a set back section extending rearwardly from the transom for supporting an outboard motor, said hull, said transom and said set back section being made of aluminum, said vee shaped hull including two sections including said strakes, said two sections being secured to said keel and forming the vee shaped hull of a substantially constant cross-section along at least a major portion of the length of said hull.

2. A boat for use with an outboard motor as claimed in claim 1, further including a wedge on opposite sides of, and adjacent to the rear edge of the hull.

3. A boat for use with an outboard motor as claimed in claim 1, wherein said set back section is located 3 to 6 inches above the bottom edge of the transom and projects 4 to 8 inches from the transom.

4. A boat for use with an outboard motor as claimed in claim 1, wherein said two sections are welded to said keel.

5. A boat for use with an outboard motor as claimed in claim 1, wherein said bow includes two concave curved portions located on opposite sides of the keel.

6. A boat for use with an outboard motor as claimed in claim 1, wherein said strakes have a constant cross section from adjacent to the bow to the rear edge located at the stern.

7. A boat for use with an outboard motor as claimed in claim 6, wherein said hull includes six strakes.

8. A boat for use with an outboard motor as claimed in claim 1, wherein said set back section includes a flat portion and two curved portions, said two curved portions connecting said flat portion to said transom.

9. A boat for use with an outboard motor as claimed in claim 1, wherein said strakes are U-shaped.

10. A boat for use with an outboard motor as claimed in claim 1, wherein said strakes are vee shaped.

11. A boat for use with an outboard motor, said boat comprising:

a vee shaped hull being of a substantially constant vee shape along at least a major portion of the length of said hull, said vee shaped hull having a central keel, a concave bow and parallel extending strakes extending from the concave bow to a rear edge of the hull, a transom, and a set back section extending rearwardly from the transom for supporting an outboard motor, said set back section being located 3 to 6 inches above the bottom edge of the transom and projecting 4 to 8 inches from the transom.

12. A boat for use with an outboard motor as claimed in claim 11, further including a wedge on opposite sides of, and adjacent to the rear edge of the hull.

13. A boat for use with an outboard motor as claimed in claim 11, wherein said vee shaped hull is made of aluminum.

14. A boat for use with an outboard motor as claimed in claim 11, wherein said vee shaped hull includes two sections including said strakes, said two sections being secured to said keel and each diverging at an angle of 10–15° to the horizontal.

15. A boat for use with an outboard motor as claimed in claim 14, wherein said two sections are welded to said keel.

16. A boat for use with an outboard motor as claimed in claim 14, wherein said bow includes two concave curved portions located on opposite sides of said keel.

17. In a boat having a bow, a transom, a bottom surface and sides extending along, and projecting upwardly from the bottom surface, and joined to the bottom surface between the bow and stern to form a boat hull, the improvement comprising the combination of:

said bow having a concave curvature to deflect water and air outwardly thereof;

said transom being formed as part thereof, a set back portion made as part thereof that projects behind said bottom surface to support an outboard engine with its propeller in spaced relation rearwardly of said bottom surface; and said bottom surface having a keel extending centrally and longitudinally thereof and projecting below said bottom surface, said bottom surface having sections on both sides of said keel sloping upwardly and outwardly in a substantially constant vee shape along at least a major portion of the length of said bottom surface to join said sides, said sections each having longitudinal strakes therein between said keel and said sides.

18. The improvement defined in claim 17, further including a wedge on opposite sides of, and adjacent to a rear edge of said bottom surface.

* * * * *